US010267206B2

(12) United States Patent
Hamamoto et al.

(10) Patent No.: US 10,267,206 B2
(45) Date of Patent: Apr. 23, 2019

(54) EXHAUST DEVICE FOR INTERNAL COMBUSTION ENGINE

(71) Applicant: NISSAN MOTOR CO., LTD., Yokohama-shi, Kanagawa (JP)

(72) Inventors: Takayuki Hamamoto, Kanagawa (JP); Takanobu Sugiyama, Kanagawa (JP); Hidehiro Fujita, Kanagawa (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 44 days.

(21) Appl. No.: 15/504,356

(22) PCT Filed: Sep. 3, 2014

(86) PCT No.: PCT/JP2014/073135
§ 371 (c)(1),
(2) Date: Feb. 16, 2017

(87) PCT Pub. No.: WO2016/035156
PCT Pub. Date: Mar. 10, 2016

(65) Prior Publication Data
US 2017/0234202 A1 Aug. 17, 2017

(51) Int. Cl.
*F01N 13/10* (2010.01)
*F01N 3/24* (2006.01)
(Continued)

(52) U.S. Cl.
CPC ..... *F01N 13/10* (2013.01); *F01N 3/24* (2013.01); *F01N 3/2892* (2013.01); *F02F 1/42* (2013.01);
(Continued)

(58) Field of Classification Search
CPC ..... F02F 1/4264
See application file for complete search history.

(56) References Cited

U.S. PATENT DOCUMENTS 4,420,933 A * 12/1983 Kajitani ..... F01N 3/28 60/299
6,009,706 A * 1/2000 Haneda ..... F01N 13/10 60/272
(Continued)

FOREIGN PATENT DOCUMENTS

DE 197 18 853 A1 11/1998
DE 1 99 05 032 A1 8/2000
(Continued)

*Primary Examiner* — Patrick D Maines
(74) *Attorney, Agent, or Firm* — Drinker Biddle & Reath LLP

(57) ABSTRACT

In inline four cylinder internal combustion engine (1), exhaust ports for a #2 cylinder and a #3 cylinder merge inside cylinder head (3) and form an opening serving as a single collective exhaust port. Exhaust manifold (5) has individual exhaust pipes (6, 7) for #1 and #4 cylinders and collective exhaust pipe (8), and the leading ends of these three exhaust pipes (6, 7, 8) are connected to catalytic converter (11). Exhaust gas introduction angle (θ2) of each of individual exhaust pipes (6, 7) is larger by 30-60 degrees than exhaust gas introduction angle (θ1) of collective exhaust pipe (8). Consequently, flow velocity distribution and temperature distribution in a catalyst carrier become uniform.

5 Claims, 7 Drawing Sheets

(51) Int. Cl.
*F02F 1/42* (2006.01)
*F01N 3/28* (2006.01)

(52) U.S. Cl.
CPC ..... *F02F 1/4264* (2013.01); *F01N 2340/02* (2013.01); *F01N 2470/18* (2013.01); *F01N 2470/20* (2013.01)

(56) References Cited

U.S. PATENT DOCUMENTS 6,555,070 B1 * 4/2003 Kruger ..... F01N 3/2853 422/177
6,745,561 B2 * 6/2004 Kim ..... F01N 3/28 60/323
8,474,252 B2 * 7/2013 Butler ..... F01N 13/08 60/305
2002/0017097 A1 * 2/2002 Maus ..... F01N 3/2892 60/324
2003/0061807 A1 4/2003 Kim
2003/0167759 A1 9/2003 Ashida et al.
2004/0226291 A1 * 11/2004 Diez ..... F01N 3/2882 60/323
2005/0150222 A1 * 7/2005 Kalish ..... F01N 3/24 60/302
2007/0283687 A1 * 12/2007 Host ..... F01N 3/2892 60/302
2010/0126153 A1 * 5/2010 Nagafuchi ..... F01N 13/001 60/299

FOREIGN PATENT DOCUMENTS

JP S63-16116 A 1/1988
JP S63-16116 A 1/1998
JP 2000-337136 A 12/2000
JP 2003-262120 A 9/2003
JP 2003-262120 A 9/2003
JP 2008-038838 A 2/2008
JP 2008-038838 A 2/2008

* cited by examiner

EXHAUST DEVICE FOR INTERNAL COMBUSTION ENGINE

TECHNICAL FIELD

This invention relates to an exhaust device for a multi-cylinder internal combustion engine, and particularly to an exhaust device for an internal combustion engine in which a collective exhaust pipe through which exhaust gases from a plurality of cylinders flow and individual exhaust pipes through which an exhaust gas from each cylinder independently flows are connected to a single catalytic converter.

BACKGROUND TECHNOLOGY

For example, in a patent document 1, in an inline four cylinder internal combustion engine, there has been disclosed an exhaust device having a configuration in which exhaust ports for a #2 cylinder and a #3 cylinder whose ignition orders are not sequential merge inside a cylinder head and exhaust ports for a #1 cylinder and a #4 cylinder are directly opened on the side surface of the cylinder head. That is, the exhaust ports for the #2 cylinder and the #3 cylinder are configured as a single collective exhaust port, and the exhaust port for the #1 cylinder and the exhaust port for the #4 cylinder are configured as an individual exhaust port independently provided for each of the cylinders. In addition, the collective exhaust port for the #2 and #3 cylinders is connected to a catalytic converter through a single collective exhaust pipe, and individual exhaust ports for the #1 cylinder and the #4 cylinder are connected to the catalytic converter through an independent individual exhaust pipe in each of the cylinders. In the patent document 1, the leading end parts of these collective exhaust pipe and individual exhaust pipes are connected to the end part of the catalytic converter so as to be basically parallel to the central axis of the catalytic converter.

In this way, in the configuration in which the exhaust ports for some cylinders merge inside the cylinder head, at the time of cold start, an exhaust gas at a high temperature which is introduced to the catalytic converter through the collective exhaust pipe can be obtained, and consequently, there is an advantage in early activation of a catalyst after starting the internal combustion engine.

However, on the other hand, the flow velocity of the exhaust gas introduced to the catalytic converter through the collective exhaust pipe and the flow velocity of an exhaust gas introduced to the catalytic converter through the individual exhaust pipe are different. That is, the passage cross sectional area of the collective exhaust pipe, in which the exhaust ports for the #2 and #3 cylinders merge, is set larger than that of the individual exhaust pipe for each of the cylinders, and the flow velocity in the collective exhaust pipe is relatively slow. With this, the exhaust gas introduced to the end part of the catalytic converter spreads out to a certain extent and reaches the end surface of a catalyst carrier. On the other hand, the flow velocity of the exhaust gas introduced from each of the individual exhaust pipes for the #1 cylinder and the #4 cylinder is high and the rectilinearity of this gas is high, and consequently, the exhaust gas locally collides with a part of the end surface of the catalyst carrier.

In addition, as compared with the temperature of the exhaust gas which flows into the catalytic converter from the collective exhaust pipe, the temperature of the exhaust gas which flows into the catalytic converter from each of the individual exhaust pipes generally becomes low.

Therefore, for example, flow velocity distribution and temperature distribution in the catalyst carrier configured as a monolithic catalyst carrier easily become non-uniform, and the early deterioration of a catalyst and cracks in the catalyst carrier caused by temperature difference are concerned.

PRIOR ART REFERENCE

Patent Document

Patent document 1: Japanese Patent Application Publication 2008-38838

SUMMARY OF THE INVENTION

In this invention, an exhaust device for an internal combustion engine has: a collective exhaust pipe through which exhaust gases of a plurality of cylinders flow; and individual exhaust pipes through which respective exhaust gases of cylinders independently flow, wherein the collective exhaust pipe and the individual exhaust pipes are connected to a diffuser portion of a single catalytic converter, and wherein an introduction angle of each of the individual exhaust pipes with respect to a central axis of the catalytic converter is set larger than an introduction angle of the collective exhaust pipe with respect to the central axis of the catalytic converter.

That is, as compared with the exhaust gas from the collective exhaust pipe, the exhaust gas at a relatively high exhaust flow velocity from each of the individual exhaust pipes is introduced into the catalytic converter at an angle more largely inclined with respect to the central axis of the catalytic converter, and consequently, the velocity component of the exhaust gas in a direction along the central axis of the catalytic converter becomes low, and the exhaust gas spreads out more widely and flows into the end surface of a catalyst carrier. Therefore, flow velocity distribution and temperature distribution in the catalyst carrier become more uniform, and the early deterioration of a catalyst and cracks in the catalyst carrier are suppressed.

MODE FOR IMPLEMENTING THE INVENTION

In the following, an embodiment of this invention will be explained in detail based on the drawings.

Figure 1:
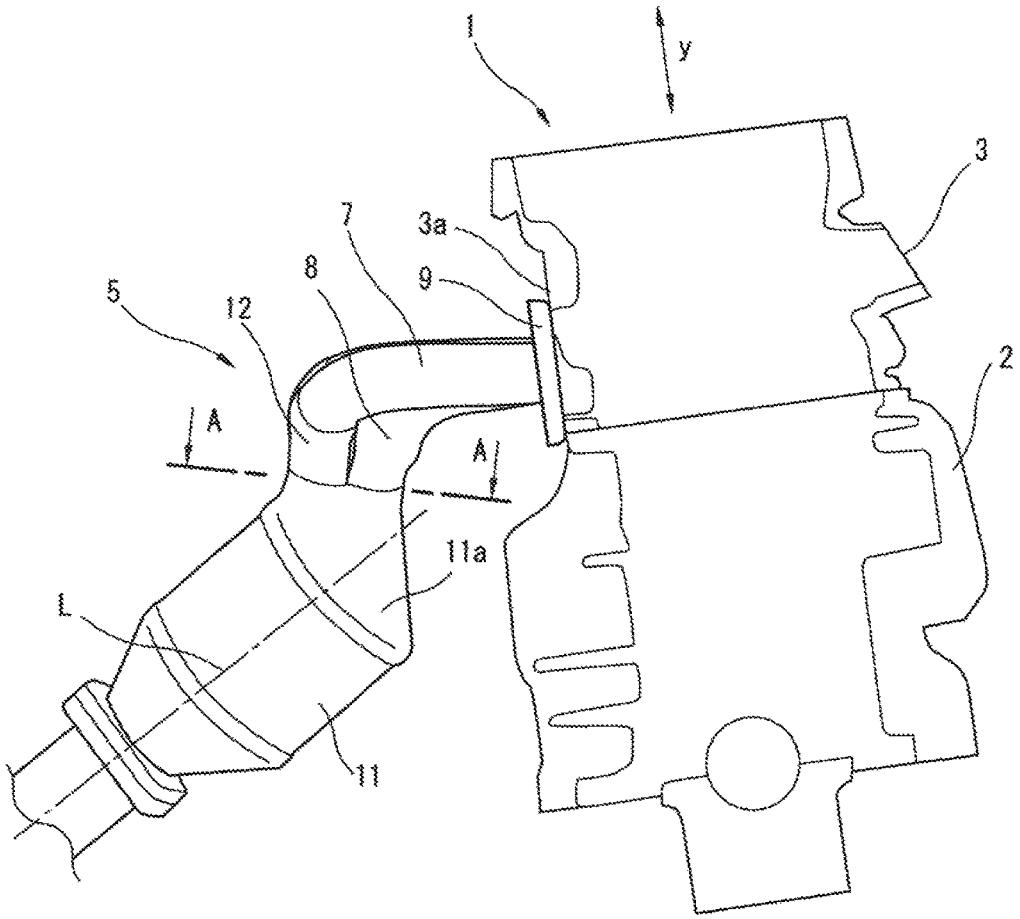
FIG. 1 is a front view showing a first embodiment of an exhaust device according to this invention.
Figure 2:
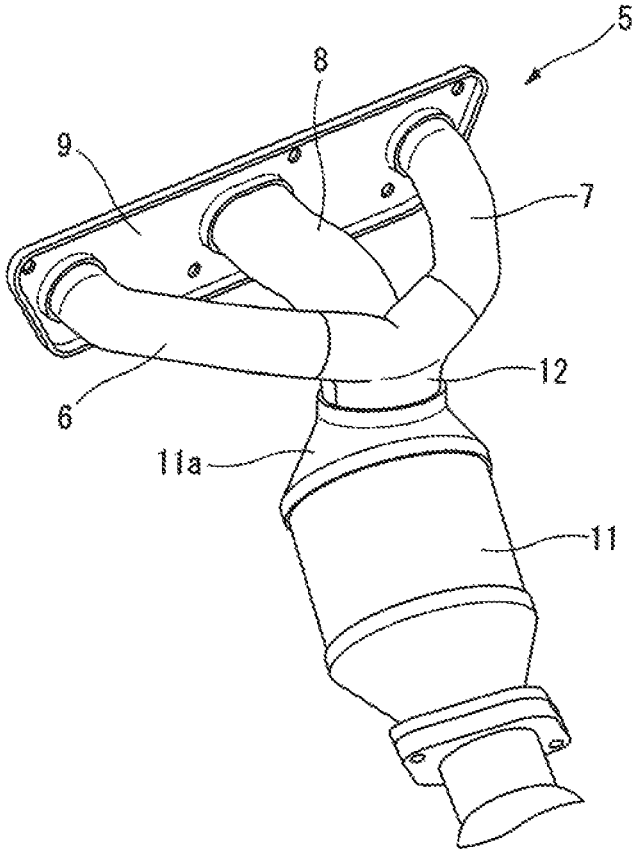
FIG. 2 is a perspective view of the first embodiment.

FIG. 1 and FIG. 2 show a first embodiment in which this invention is applied to an inline four cylinder internal combustion engine 1. The internal combustion engine 1 has a cylinder block 2 and a cylinder head 3, and an exhaust port (not shown in the drawings) of each cylinder extends toward one side surface 3*a* of the cylinder head 3. Here, the exhaust ports of a #1 cylinder and a #4 cylinder are opened on the side surface 3*a* of cylinder head 3 independently for each of the cylinders as an individual exhaust pipe. The exhaust ports of a #2 cylinder and a #3 cylinder merge with each other inside cylinder head 3, and form an opening on side surface 3*a* of cylinder head 3 as a single collective exhaust port. In addition, the ignition timings of the #2 cylinder and the ignition timing of the #3 cylinder are different from each other by 360° CA, and exhaust interference does not occur.

As shown in FIG. 2, an exhaust manifold 5 which is attached to side surface 3*a* of cylinder head 3 has a #1 individual exhaust pipe 6 connected to the individual exhaust port for the #1 cylinder, a #4 individual exhaust pipe 7 connected to the individual exhaust port for the #4 cylinder and a collective exhaust pipe 8 connected to the collective exhaust port in the middle of the exhaust manifold 5. The base ends of these three exhaust pipes 6, 7 and 8 are supported by a head attachment flange 9. There are #1 individual exhaust pipe 6 and #4 individual exhaust pipe 7 having substantially circular shapes in cross section. In addition, there is collective exhaust pipe 8 having an elongated elliptical shape extending in a cylinder row direction in cross section. The passage cross-sectional area of collective exhaust pipe 8 is set larger than the passage cross-sectional area of each of #1 individual exhaust pipe 6 and #4 individual exhaust pipe 7.

The leading end of each of #1 individual exhaust pipe 6, #4 individual exhaust pipe 7 and collective exhaust pipe 8 is connected to a diffuser portion 11*a* on the upstream side of a single catalytic converter 11. The catalytic converter 11 is one in which a columnar monolithic catalyst carrier is accommodated in a cylindrical case made of a metal. The diffuser portion 11*a* is formed into a substantially conical shape so as to form a space whose diameter is gradually enlarged between a part of diffuser portion 11*a* where the leading end is connected and the end surface of the catalyst carrier.

As shown in FIG. 1, catalytic converter 11 is arranged on a side of cylinder block 2, and the central axis L of catalytic converter 11 is positioned so as to be inclined obliquely outward with respect to the vertical direction (an arrow y direction in FIG. 1) of internal combustion engine 1. In addition, as shown in FIG. 2, as to the cylinder row direction, catalytic converter 11 is arranged at a position in a substantially center of cylinder head 3 (that is, the side of the collective exhaust port for the #2 and #3 cylinders).

Figure 3:
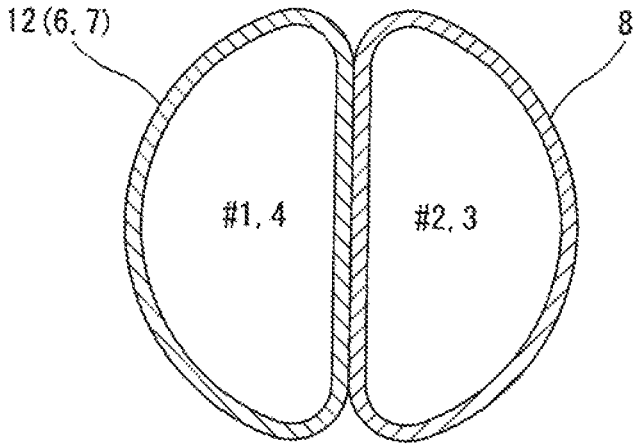
FIG. 3 is a sectional view taken along a line A-A of FIG. 1.

Collective exhaust pipe 8 extends straightly along a direction orthogonal to the cylinder row direction from the head attachment flange 9, and the leading end part of collective exhaust pipe 8 curves downward and is connected to the conical surface of diffuser portion 11*a*, conical surface which is turned upward (in particular, it is connected to a part close to the central axis L). As shown in FIG. 3, in the connection part of collective exhaust pipe 8 and catalytic converter 11, collective exhaust pipe 8 has a substantially semi-circular shape in cross section.

In addition, #1 individual exhaust pipe 6 and #4 individual exhaust pipe 7, which are located at front and rear sides in the cylinder row direction, curve and extend in the cylinder row direction so as to be substantially symmetrical in a plan view, and the leading end parts of #1 individual exhaust pipe 6 and #4 individual exhaust pipe 7 curve downward and are connected to the conical surface of diffuser portion 11*a*, conical surface which is turned upward (in particular, it is connected to a part close to the outer circumference of the conical surface and relatively apart from the central axis L). More specifically, #1 individual exhaust pipe 6 and #4 individual exhaust pipe 7 merge at a position immediately close to catalytic converter 11 in a form of a substantially Y shape or a substantially T shape, and a connection pipe portion 12 formed by merging #1 individual exhaust pipe 6 and #4 individual exhaust pipe 7 is connected to diffuser portion 11*a*. As shown in FIG. 3, the connection pipe portion 12 has a substantially semi-circular shape in cross section, which is symmetrical to the end part of collective exhaust pipe 8.

Figure 4:
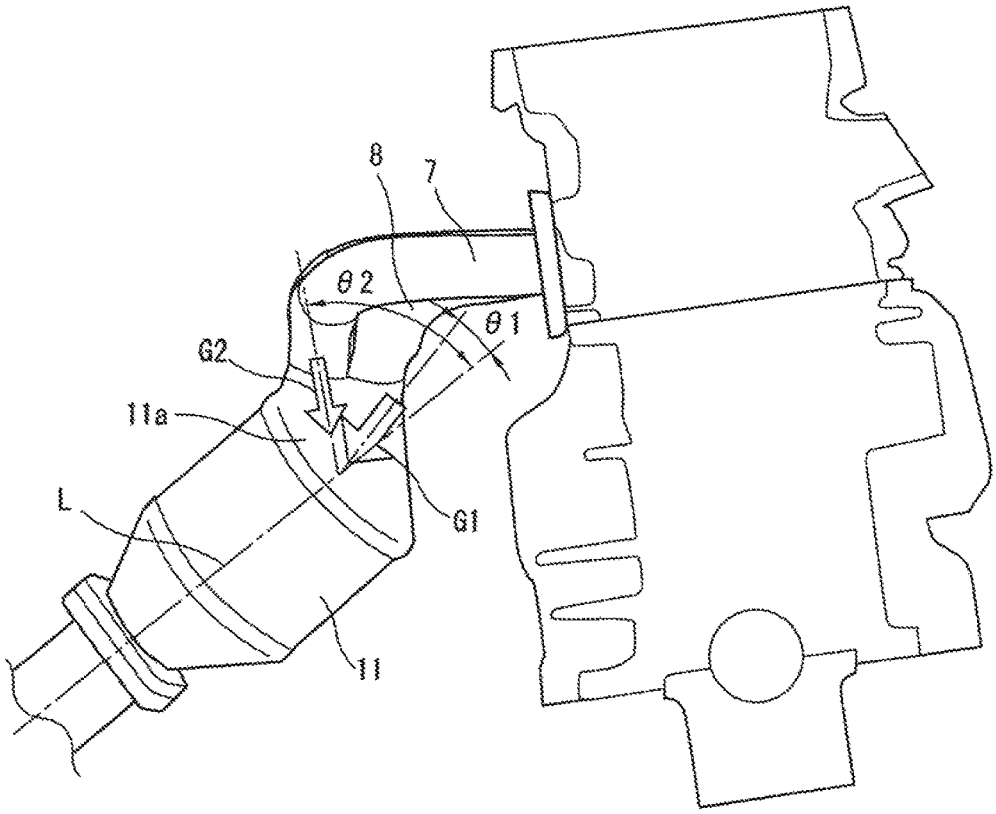
FIG. 4 is an explanation drawing showing the introduction angle of each exhaust gas in the first embodiment.

FIG. 4 is an explanation drawing showing the introduction angles of exhaust gases flowing into diffuser portion 11*a* from individual exhaust pipes 6 and 7 and collective exhaust pipe 8. The exhaust gas flows into diffuser portion 11*a* along the direction of an arrow G1, and heads toward the end surface of the catalyst carrier, after flowing through collective exhaust pipe 8 for the #2 and #3 cylinders. The introduction angle θ1 of the arrow G1 with respect to central axis L of catalytic converter 11 is not zero. However, it is relatively small. On the other hand, the exhaust gas flows through each of the individual exhaust pipes 6 and 7, following which it flows into diffuser portion 11*a* along the direction of an arrow G2 through connection pipe portion 12, and heads toward the end surface of the catalyst carrier. The introduction angle θ2 of the arrow G2 with respect to central axis L of catalytic converter 11 is relatively larger than introduction angle θ1 of arrow G1. Preferably, the difference between introduction angle θ1 and introduction angle θ2 is 30-60 degrees.

In the above configuration, the exhaust gases of #2 and #3 cylinders, which flow through collective exhaust pipe 8, flow into diffuser portion 11*a* at a relatively slow flow velocity because the passage cross-sectional area of collective exhaust pipe 8 is large. The gases therefore sufficiently spread out in diffuser portion 11*a* and then reach the end surface of the catalyst carrier. On the other hand, after flowing through each of #1 individual exhaust pipe 6 and #4 individual exhaust pipe 7, the exhaust gas flows into diffuser portion 11*a* at a relatively high flow velocity. However, the gas is introduced with an inclination with respect to the catalyst carrier at large introduction angle θ2 from a part close to the outer circumference of diffuser portion 11*a*, and consequently, the velocity component of the exhaust gas in the direction along central axes L becomes low and the gas spreads out widely to the end surface of the catalyst carrier.

Therefore, the exhaust gas of each of cylinders spreads out more uniformly to the whole catalyst carrier, and flows in the catalyst carrier at a more uniform velocity. Consequently, a difference in the flow velocity and a difference in temperature in each part of the catalyst carrier become small, and the early deterioration of a catalyst and cracks in the catalyst carrier caused by these flow velocity difference and temperature difference are suppressed.

Figure 5:
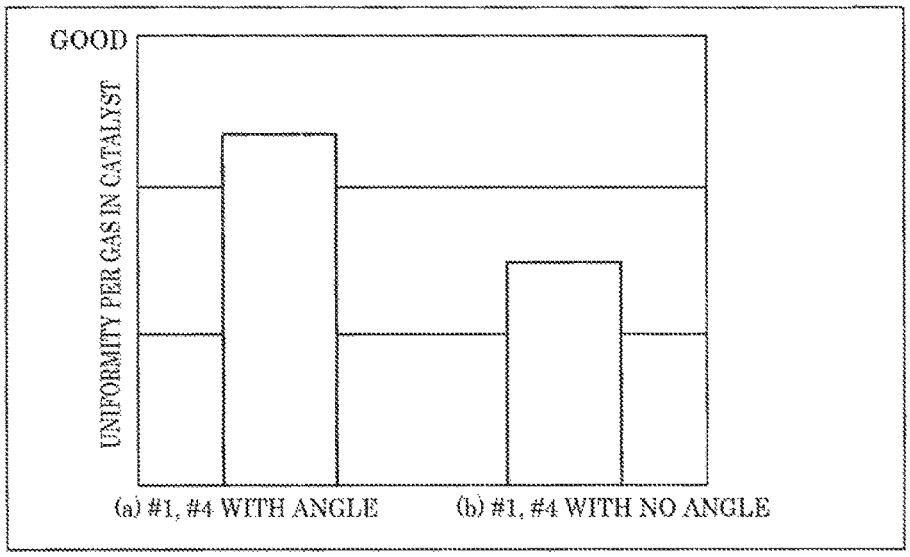
FIG. 5 is a characteristic chart in which uniformity per catalytic gas of the first embodiment is compared with that of a relative example.

FIG. 5 is a characteristic chart in which uniformity per gas in the end surface of the catalyst carrier in the configuration (a) of the above embodiment is compared with that of a comparative example (b) in which the leading end portions of #1 individual exhaust pipe 6 and #4 individual exhaust pipe 7 are connected to catalytic converter 11 so as to be parallel to collective exhaust pipe 8. As shown in the drawing, if #1 individual exhaust pipe 6 and #4 individual exhaust pipe 7 are parallel to collective exhaust pipe 8 (that is, the difference between introduction angles θ1 and θ2 is zero), since the flow velocity in the exhaust gas of each of individual exhaust pipes 6 and 7 is high, the uniformity per gas becomes non-uniform. On the other hand, by giving an angle difference between introduction angles θ1 and θ2 as the above embodiment, the uniformity per gas is improved.

Figure 6:
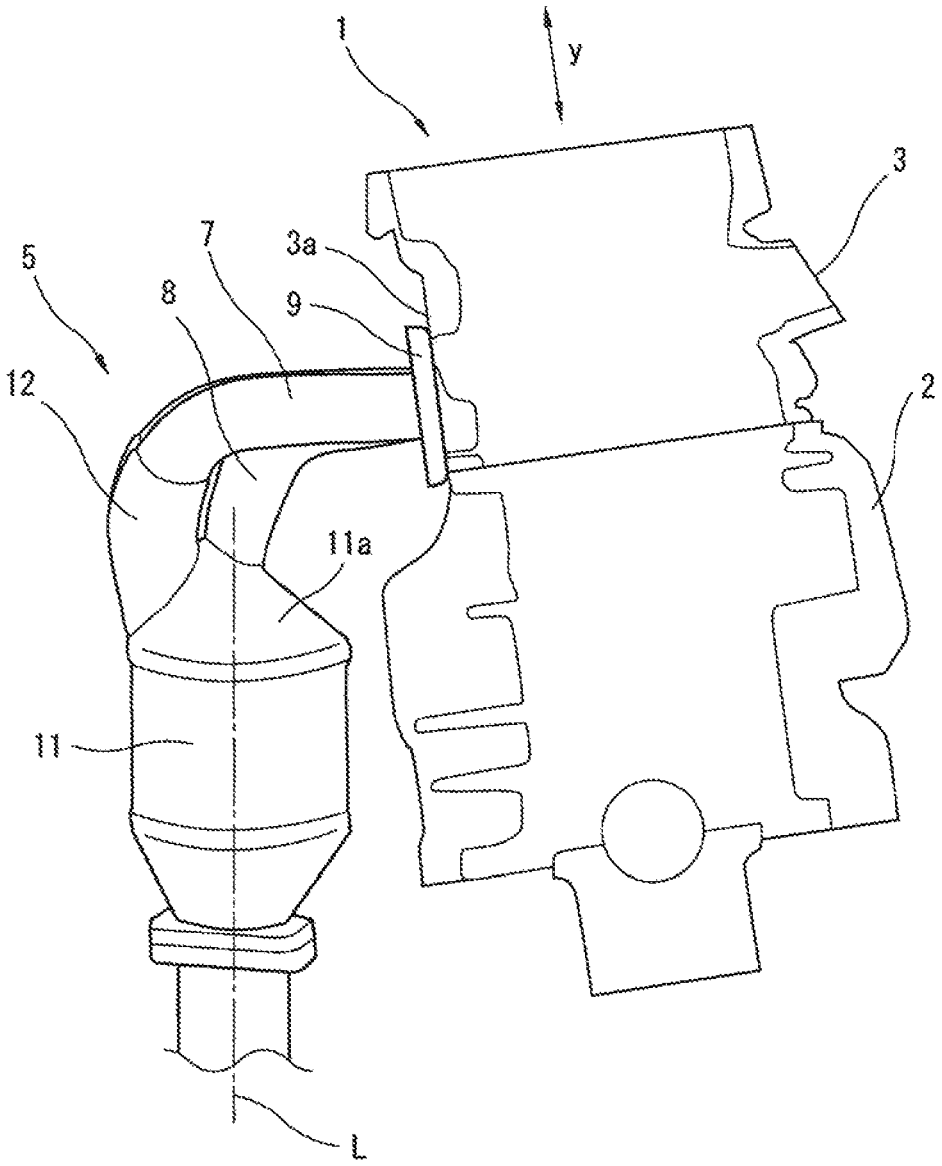
FIG. 6 is a front view showing a second embodiment of the exhaust device according to this invention.
Figure 7:
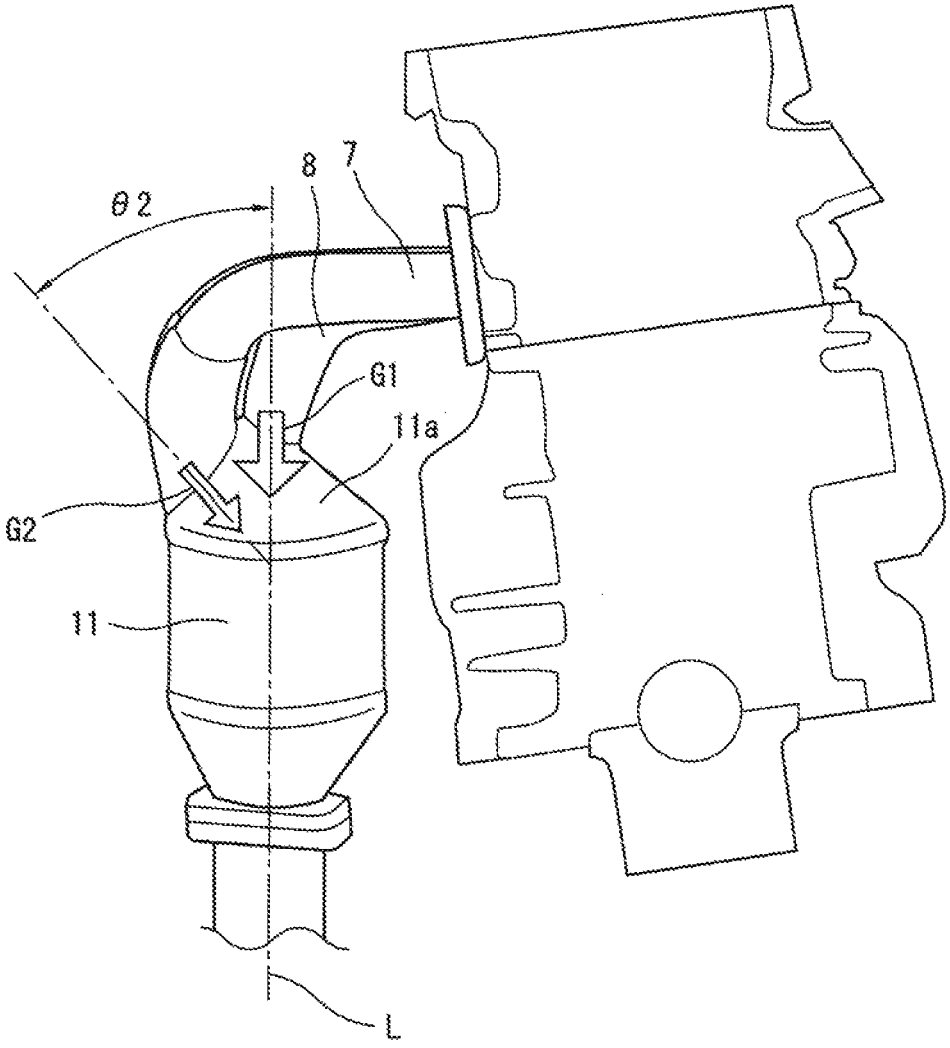
FIG. 7 is an explanation drawing showing the introduction angle of each exhaust gas in the second embodiment.

Next, FIG. 6 and FIG. 7 show a second embodiment of this invention. In this embodiment, as to catalytic converter 11, its central axes L is set so as to be substantially parallel in the vertical direction (the arrow y direction of FIG. 6) of internal combustion engine 1.

In addition, the leading end part of collective exhaust pipe 8 which is curved downward is connected to a part close to the top part (in other words, the central part) of diffuser portion 11*a* forming the substantially conical shape. More specifically, the leading end part of collective exhaust pipe 8 is connected to be parallel to central axis L, and an exhaust gas introduction direction shown by arrow GI in FIG. 7 is set substantially along central axis L. That is, the introduction angle of arrow G1 with respect to central axis L is approximately zero.

The leading end parts of #1 individual exhaust pipe 6 and #4 individual exhaust pipe 7 merge together at a part immediately close to catalytic converter 11 in a form of a substantially Y shape or a substantially T shape, basically similar to the first embodiment. Connection pipe portion 12 formed by merging them is connected to a part close to the outer circumference of diffuser portion 11*a*. More specifically, as shown by arrow G2 in FIG. 7, connection pipe portion 12 is connected so as to direct its exhaust introduction direction obliquely inward. Introduction angle θ2 of this arrow G2 with respect to central axis L is preferably 30-60 degrees.

Consequently, similar to the first embodiment, flow velocity distribution and temperature distribution in each part of the catalyst carrier become more uniform.

The invention claimed is:

1. An exhaust device for an internal combustion engine, comprising:

a collective exhaust pipe through which exhaust gases of a plurality of cylinders flow; and a plurality of individual exhaust pipes through which respective exhaust gases of cylinders independently flow, wherein the collective exhaust pipe and the individual exhaust pipes are connected to a diffuser portion of a single catalytic converter, and wherein an introduction angle of each of the individual exhaust pipes with respect to a central axis of the catalytic converter is set larger than an introduction angle of the collective exhaust pipe with respect to the central axis of the catalytic converter, wherein the plurality of the individual exhaust pipes merge at a part immediately close to the catalytic converter and are connected to the diffuser portion, and wherein a passage cross-sectional area of the collective exhaust pipe is set larger than a passage cross-sectional area of each of the individual exhaust pipes.

2. The exhaust device for the internal combustion engine according to claim 1, wherein the internal combustion engine is an inline four cylinder internal combustion engine, wherein exhaust ports for a #2 cylinder and a #3 cylinder merge inside a cylinder head and form a single collective exhaust port, and wherein the collective exhaust pipe is connected to the collective exhaust port.

3. The exhaust device for the internal combustion engine according to claim 1, wherein the central axis of the catalytic converter is set obliquely outward with respect to a vertical direction of the internal combustion engine, and wherein a leading end part of the collective exhaust pipe which is directed downward is connected to be inclined with respect to the central axis.

4. The exhaust device for the internal combustion engine according to claim 1, wherein the central axis of the catalytic converter is set to be substantially parallel to a vertical direction of the internal combustion engine, and wherein a leading end part of the collective exhaust pipe which is directed downward is connected to be substantially parallel to the central axis.

5. The exhaust device for the internal combustion engine according to claim 1, wherein a difference between the introduction angle of each of the individual exhaust pipes and the introduction angle of the collective exhaust pipe is 30-60 degrees.

* * * * *